US008033689B2

(12) United States Patent
Scott

(10) Patent No.: US 8,033,689 B2
(45) Date of Patent: Oct. 11, 2011

(54) FLUID PIPE HEAT SINK APPARATUS FOR SOLID STATE LIGHTS

(75) Inventor: Keith Scott, Sunnyvale, CA (US)

(73) Assignee: Bridgelux, Inc., Livermore, CA (US)

( * ) Notice: Subject to any disclaimer, the term of this patent is extended or adjusted under 35 U.S.C. 154(b) by 224 days.

(21) Appl. No.: 12/234,481

(22) Filed: Sep. 19, 2008

(65) Prior Publication Data

US 2010/0073933 A1 Mar. 25, 2010

(51) Int. Cl.
*F21V 29/00* (2006.01)

(52) U.S. Cl. ..... 362/294; 362/373

(58) Field of Classification Search ..... 362/297, 362/294, 253, 345, 373, 264, 218, 126, 547, 362/580

See application file for complete search history.

(56) References Cited

U.S. PATENT DOCUMENTS

| | | | | |
|---|---|---|---|---|
| 1,895,887 | A * | 1/1933 | Lorenz | 362/294 |
| 6,480,515 | B1 | 11/2002 | Wilson | |
| 6,787,999 | B2 | 9/2004 | Stimac et al. | |
| 6,860,620 | B2 | 3/2005 | Kuan et al. | |
| 7,309,145 | B2 * | 12/2007 | Nagata et al. | 362/294 |
| 7,438,449 | B2 | 10/2008 | Lai et al. | |
| 2001/0030866 | A1 | 10/2001 | Hochstein | |
| 2004/0000677 | A1 | 1/2004 | Dry | |
| 2005/0007772 | A1 | 1/2005 | Yen | |
| 2005/0168990 | A1 * | 8/2005 | Nagata et al. | 362/294 |
| 2007/0091622 | A1 * | 4/2007 | Huang et al. | 362/373 |
| 2007/0098334 | A1 | 5/2007 | Chen | |
| 2007/0230186 | A1 | 10/2007 | Chien | |
| 2007/0253202 | A1 | 11/2007 | Wu et al. | |
| 2007/0285920 | A1 | 12/2007 | Seabrook | |
| 2008/0037255 | A1 | 2/2008 | Wang | |
| 2008/0049399 | A1 | 2/2008 | Lu et al. | |
| 2008/0055909 | A1 | 3/2008 | Li | |
| 2008/0062694 | A1 * | 3/2008 | Lai et al. | 362/294 |
| 2008/0112170 | A1 | 5/2008 | Trott et al. | |
| 2009/0052187 | A1 * | 2/2009 | Li | 362/294 |

OTHER PUBLICATIONS

PCT Search report of Aug. 27, 2009 for PCT/US 09/49104.
PCT Search Report of Sep. 1, 2009 for PCT/US 09/49103.
PCT Search Report of Aug. 27, 2009 for PCT/US 09/49096.
PCT Search report of Aug. 27, 2009 for PCT/US 09/49099.
U.S. Appl. No. 12/165,544, filed Jun. 30, 2008, Keith Scott.
U.S. Appl. No. 12/165,563, filed Feb. 28, 2009, Keith Scott.
U.S. Appl. No. 12/165,570, filed Jun. 30, 2008, Keith Scott.

* cited by examiner

*Primary Examiner* — Bao Q Truong
(74) *Attorney, Agent, or Firm* — Haynes and Boone, LLP

(57) ABSTRACT

One embodiment of the current invention seeks to increase heat dissipation in solid state lights used in track lighting systems, by utilizing a track with a fluid channel. Convective heat transfer within this fluid channel acts to dissipate more heat than can be typically dissipated by conventional solid state lights themselves, thus allowing for brighter, higher-powered lights. The track and fluid channel can take on various forms.

19 Claims, 5 Drawing Sheets

FLUID PIPE HEAT SINK APPARATUS FOR SOLID STATE LIGHTS

BRIEF DESCRIPTION OF THE INVENTION

This invention relates generally to solid state lights. More specifically, this invention relates to fluid pipe heat sink apparatuses for solid state lights.

BACKGROUND OF THE INVENTION

The operational power of many current solid state lights, such as light-emitting diode (LED) lights, is often limited by the solid state lights' ability to dissipate heat. More particularly, increasing the current of a solid state light increases the amount of heat generated. Beyond a certain point, this excess heat becomes detrimental to the performance of the solid state device, resulting in reduced performance and/or operational life. Accordingly, increasing the ability of a solid state light to dissipate heat allows for higher power, and thus brighter, solid state lights. Thus, ongoing efforts exist to increase the amount of heat dissipated from solid state lights.

SUMMARY OF THE INVENTION

The invention can be implemented in a number of ways. In one embodiment, a solid state light system comprises a plurality of solid state light fixtures thermally coupled to a fluid cooling system. The fluid cooling system comprises at least one vessel for holding a thermally conductive fluid, the vessel supporting a current in the thermally conductive fluid so as to facilitate a dissipation of heat from at least one of the solid state light fixtures.

In another embodiment, a cooling system for lights comprises a track lighting track, and a plurality of solid state light fixtures coupled to the track. Also included is at least one enclosed reservoir containing a thermally conductive fluid, the at least one reservoir placing the solid state light fixtures in thermal communication with the fluid. The at least one reservoir has a shape allowing heat from the solid state light fixtures to induce a current in the fluid. Also included is a heat sink in thermal communication with the fluid and configured to dissipate heat from the fluid as the current carries the fluid past the heat sink.

Other aspects and advantages of the invention will become apparent from the following detailed description taken in conjunction with the accompanying drawings which illustrate, by way of example, the principles of the invention.

BRIEF DESCRIPTION OF THE DRAWINGS

For a better understanding of the invention, reference should be made to the following detailed description taken in conjunction with the accompanying drawings, in which.

Like reference numerals refer to corresponding parts throughout the drawings.

DETAILED DESCRIPTION OF EMBODIMENTS OF THE INVENTION

As noted above, ongoing efforts exist to increase the heat dissipation of solid state lights. One embodiment of the current invention seeks to increase heat dissipation in solid state lights used in track lighting systems, by utilizing a track with a fluid channel. Heat transfer within this fluid channel acts to dissipate more heat than can be typically dissipated by conventional solid state lights themselves, thus allowing for brighter, higher-powered lights. The track and fluid channel can take on various forms, in accordance with various embodiments of the invention.

Figure 1:
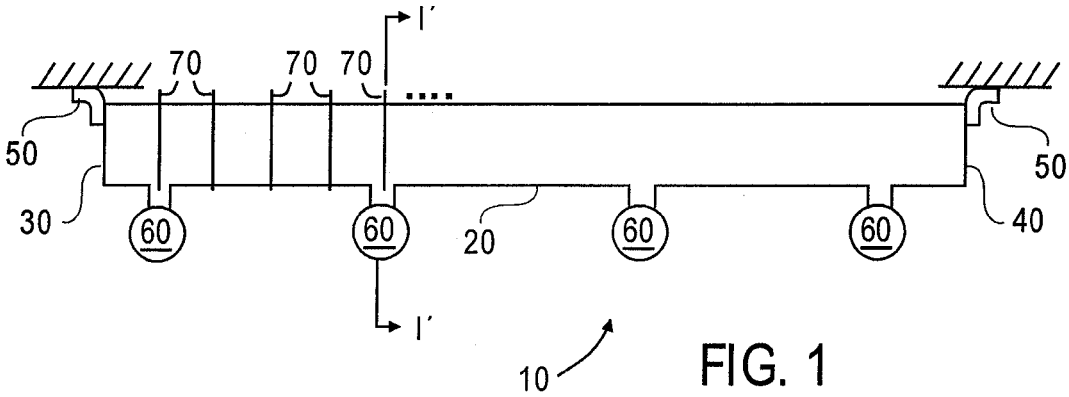
FIG. 1 illustrates a track lighting system for solid state lights, constructed in accordance with an embodiment of the present invention.

FIG. 1 illustrates a track lighting system for solid state lights, constructed in accordance with an embodiment of the present invention. Track lighting system 10 includes a track 20 that is an elongated member with left and right ends 30, 40. Brackets 50 or any other fastening device(s) can be employed to affix the track lighting system 10 to structures such as ceilings, if desired. The track 20 supports a number of solid state lights 60, as well as a number of heat sink fins 70. The track 20 can be configured with fixtures, i.e. simply any interface to a light 60, so that lights 60 can be placed in thermal communication with the track 20 itself. Alternatively, track 20 can be configured to interface with fixtures such as known light sockets. The invention contemplates any connection between track 20 and lights 60 that provides for sufficient electrical and thermal connectivity. For example, the track 20 can support sockets such as known screw-type and bi-pin sockets, as well as other mechanisms such as known twist-and-lock or snap-in mechanisms. Accordingly, the "fixtures" employed can be any interface to a light 60, whether a separate device or merely a portion of the track 20 itself.

Figure 2:
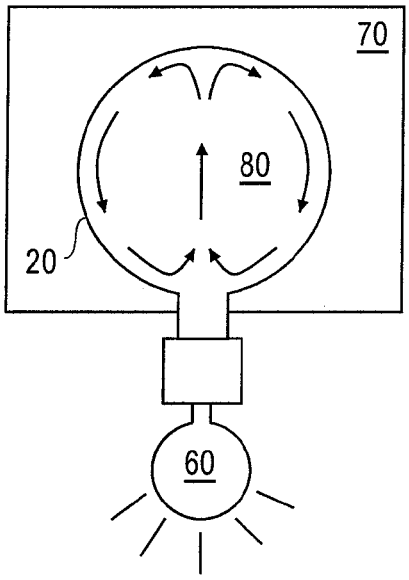
FIG. 2 illustrates a cross-sectional view taken along section I-I' of FIG. 1.

In the embodiment of FIG. 1, the track 20 is a hollow, sealed tubelike vessel that acts as a closed pipe, containing a thermally conductive fluid 80 sealed within. FIG. 2 illustrates a cross-sectional view taken along section I-I' of FIG. 1, more clearly showing details of the track 20 and fluid 80 contained therein. In operation, heat generated by lights 60 heats the fluid 80, generating a current roughly as shown by the arrows of FIG. 2. This current transfers heat to the outer surface of the track 20 and the fins 70, where it is dissipated. In this manner, the track 20 both supports the lights 60 and acts as a fluid cooling system for dissipating heat from the lights 60. That is, the track 20 of this embodiment is also a fluid-containing vessel, or "pipe," for dissipating heat.

The fluid 80 can be any thermally conductive fluid, such as a thermally conductive oil, alcohol, or water-based solution. Additionally, although the embodiment of FIG. 1 has fins 70 to aid in heat dissipation, the invention also encompasses embodiments that do not employ fins. For example, fins may not be necessary for tracks 20 that are to be utilized in sufficiently cool environments, or that are to be cooled in a secondary chamber.

Figure 3:
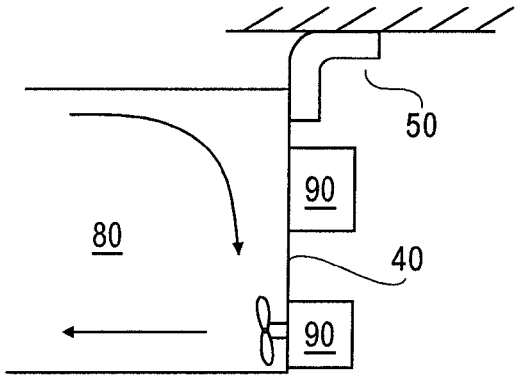
FIG. 3 illustrates a more detailed view of one end of the track lighting system of FIG. 1.

While FIG. 2 illustrates currents generated within the conductive fluid 80 as shown, the invention contemplates any such current(s), flowing in any direction(s), that serves to generally increase heat dissipation from the lights 60. To that end, it is noted that the invention can employ both "passive" currents, i.e. currents induced by the heat of lights 60, as well as "active" currents such as those shown in FIG. 3. FIG. 3 illustrates a more detailed view of right end 40 of track 20, in which a fluid propulsion device 90 is employed to generate a current within fluid 80 as shown. Here, although the invention contemplates any device capable of propelling fluid, fluid propulsion device 90 has a propeller-like extension that is spun to propel fluid 80, thus generating a current as shown. This current assists in carrying the fluid 80 along the track 20 and fins 70, thus convectively transferring heat from the lights 60 to the outer surface of track 20 as well as to fins 70. Also affixed to right end 40 is a driver 90 providing electrical power to lights 60 via wires or other electrical connections (not shown). The invention contemplates the placement of driver 90 anywhere convenient to supply power to lights 60.

Figure 4:
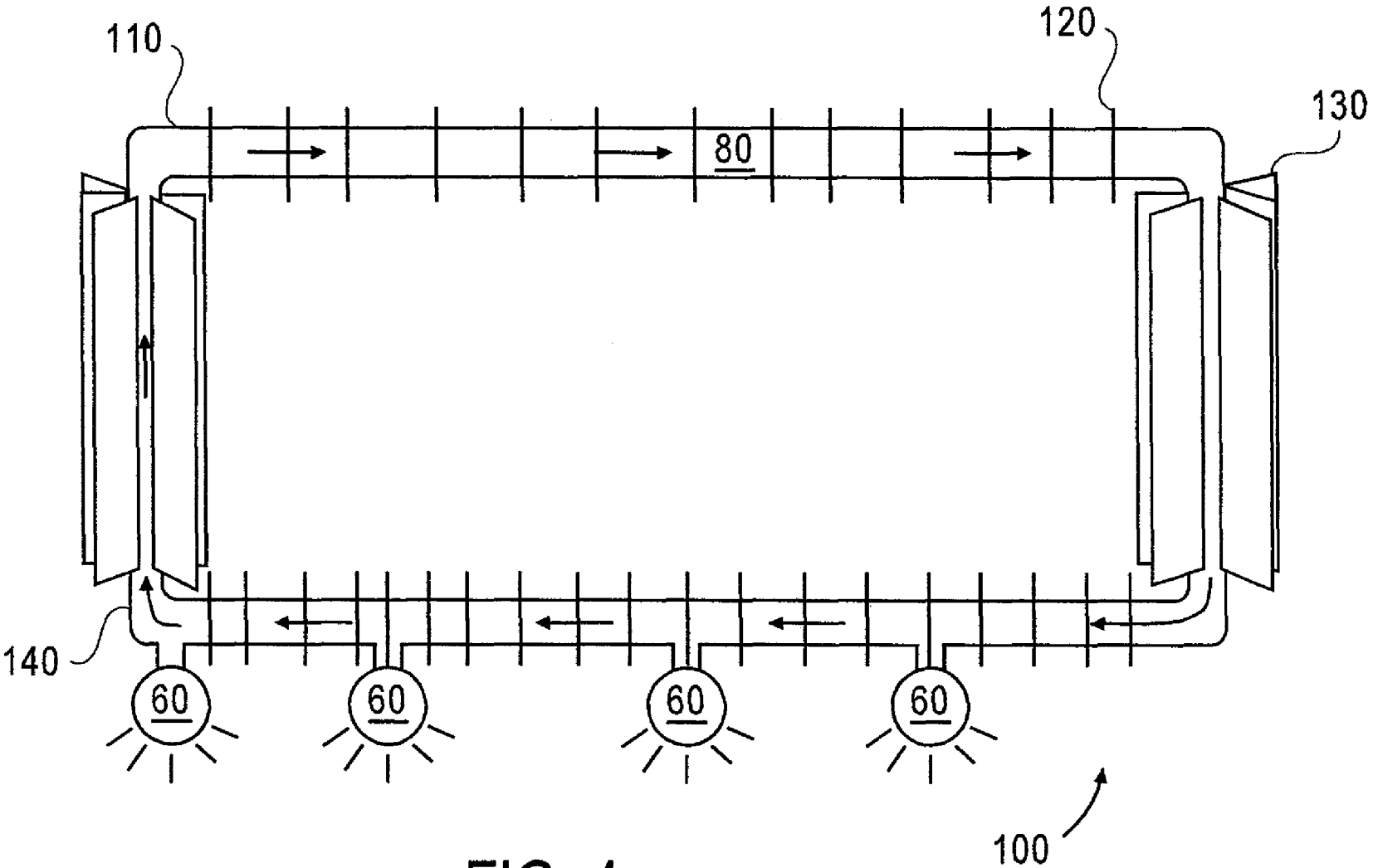
FIG. 4 illustrates a track lighting system for solid state lights, constructed in accordance with a further embodiment of the present invention.

While the embodiment of FIGS. 1-3 shows a generally horizontally-oriented, linear track 20, it should be recognized that the invention is not limited to this configuration. Rather, the invention encompasses any configuration of track 20 that employs a fluid reservoir that convectively transfers heat away from lights 60. FIG. 4 is an example of one such configuration. FIG. 4 illustrates a track lighting system for solid state lights, constructed in accordance with a further embodiment of the present invention. Track lighting system 100 has a track 110 configured as a closed loop containing fluid 80, with lights 60 extending from track 110 as shown. The track 110 is configured to be mounted or installed in a generally upright or angled orientation, so that heat from the lights 60 induces a current in the fluid 80 that flows in the direction shown by the arrows. The fins 120, 130 are oriented to allow convective air currents to travel generally unimpeded across the surface of the fins 120, 130. Thus, for example, for a vertically-mounted track 110, fins 120 extend generally radially from the major axis of the track 110 (i.e., generally perpendicular to the track 110), while fins 130 extend generally circumferentially along the track 110 (i.e., generally parallel to the track 110).

In operation then, heat from the lights 60 heats the fluid 80, inducing a current that flows in the direction shown. This current carries heat from the lights 60 to the outer surface of the track 110 as well as the fins 120, 130, where it is dissipated.

One of ordinary skill in the art will realize that the embodiment shown can employ a fluid propulsion device, such as device 90, to actively induce a current. Those of ordinary skill in the art will also realize that the embodiment shown can utilize currents generated by heat from the lights 60 instead. In that case, the lights 60 are arranged along the track 110 as shown, with leftmost light 60 proximate to the leftmost portion 140 of track 110. In this manner, heat from the leftmost light 60 travels up along the leftmost portion 140, inducing a current that flows in the direction shown.

Figure 5:
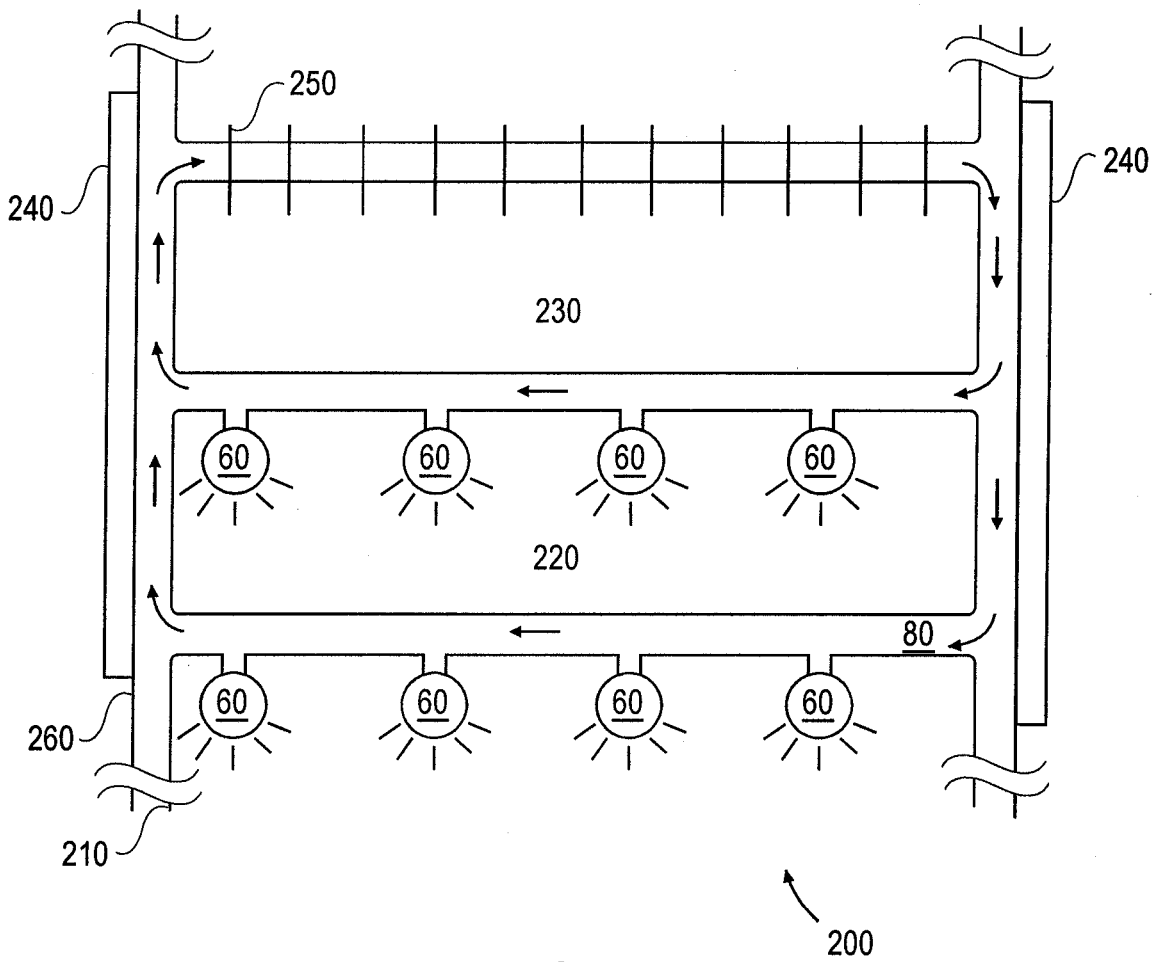
FIG. 5 illustrates a track lighting system for solid state lights, constructed in accordance with a still further embodiment of the present invention.

FIG. 5 illustrates a still further embodiment of the present invention, similar in some respects to the embodiment of FIG. 4. Here, track lighting system 200 includes a track 210 configured as a pipe or other such vessel that acts as a reservoir for fluid 80. Similar to FIG. 4, the track lighting system 200 of FIG. 5 is a closed loop system. However, instead of being configured with a single loop like that of FIG. 4, the track lighting system 200 of FIG. 5 is configured with multiple loops 220, 230 each in fluid communication with the other. The track 210 is also configured to be oriented so that heat from lights 60 induces a current that flows in the direction of the arrows, as shown. Fins 240 (any number of which are contemplated by the invention) extend generally circumferentially from the track 210, while fins 250 extend generally radially from the track 210. The invention encompasses any number and combination of radial and/or circumferential fins 240, 250, placed anywhere along the track 210 that allows for flow of air across the surface of the fins 240, 250.

In operation, a current within fluid 80 carries heat from the lights 60 to the outer surface of the track 210 and/or fins 240, 250, where it is dissipated, thus cooling the lights 60. As above, this current can be generated by a fluid propulsion device such as device 90, or induced by heat from lights 60. In this latter case, the leftmost lights 60 are placed proximate to the leftmost portion 260 of the track 210, so that heat from the leftmost lights 60 induces a current as shown. The invention encompasses configurations employing any number of loops 220, 230, as well as any number of fins 240, 250 placed anywhere on the track 210 that is useful for heat dissipation.

Figure 6A:
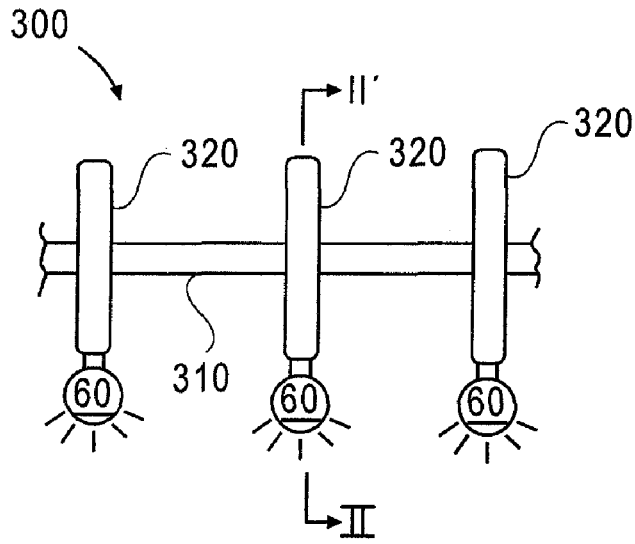
FIGS. 6A-6C illustrate track lighting systems for solid state lights, constructed in accordance with still further embodiments of the present invention.
Figure 6B:
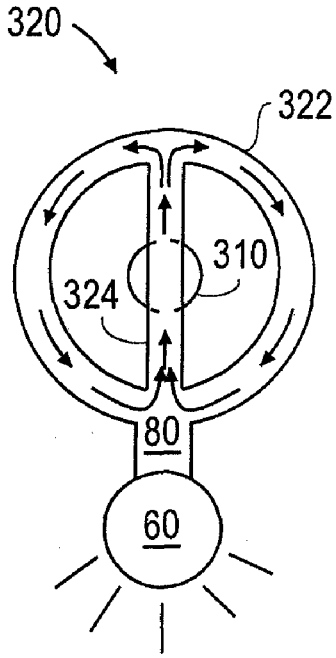
Figure 6C:
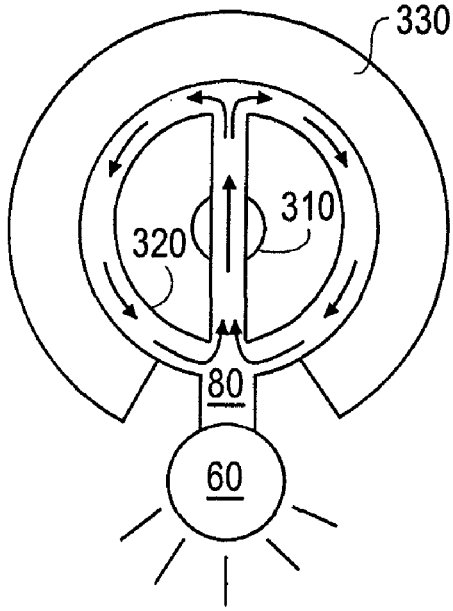

FIGS. 6A-6C illustrate yet a further embodiment of the present invention. Here, track lighting system 300 includes a track 310 that does not contain any fluid reservoir, but instead serves to support a number of fluid cooling vessels 320. In this embodiment, each vessel 320 has a first portion 322 that allows for circulation and cooling of fluid 80, and a second portion 324 that is supported by the track 310 and that extends between the first portion 322. Each first portion 322 also supports, and is in thermal communication with, a light 60. Furthermore, the first and second portions 322, 324 are hollow vessels containing fluid 80. In operation, track lighting system 300 is placed so that second portions 324 are oriented generally vertically. In this configuration, heat from the lights 60 heats the fluid 80, inducing currents in the fluid 80 that flow in the direction of the arrows as shown. This circulation carries heat from the lights 60 up into the second portion 324 and through the first portion 322, where it is cooled by the surrounding air, perhaps with assistance from an additional heat sink such as fin 330.

FIGS. 6A-6C illustrate a generally toroidal first portion 322, a generally tubelike second portion 324, and a fin 330 extending generally radially with respect to the track 310. However, one of ordinary skill in the art will realize that the first and second portions 322, 324 can be of any size and shape that allows for circulation of fluid 80, and thus more effective dissipation of heat from the lights 60. Additionally, those of ordinary skill in the art will realize that the fin 330 can be of any size, shape, or orientation that facilitates dissipation of heat from the fluid 80.

Figure 7:
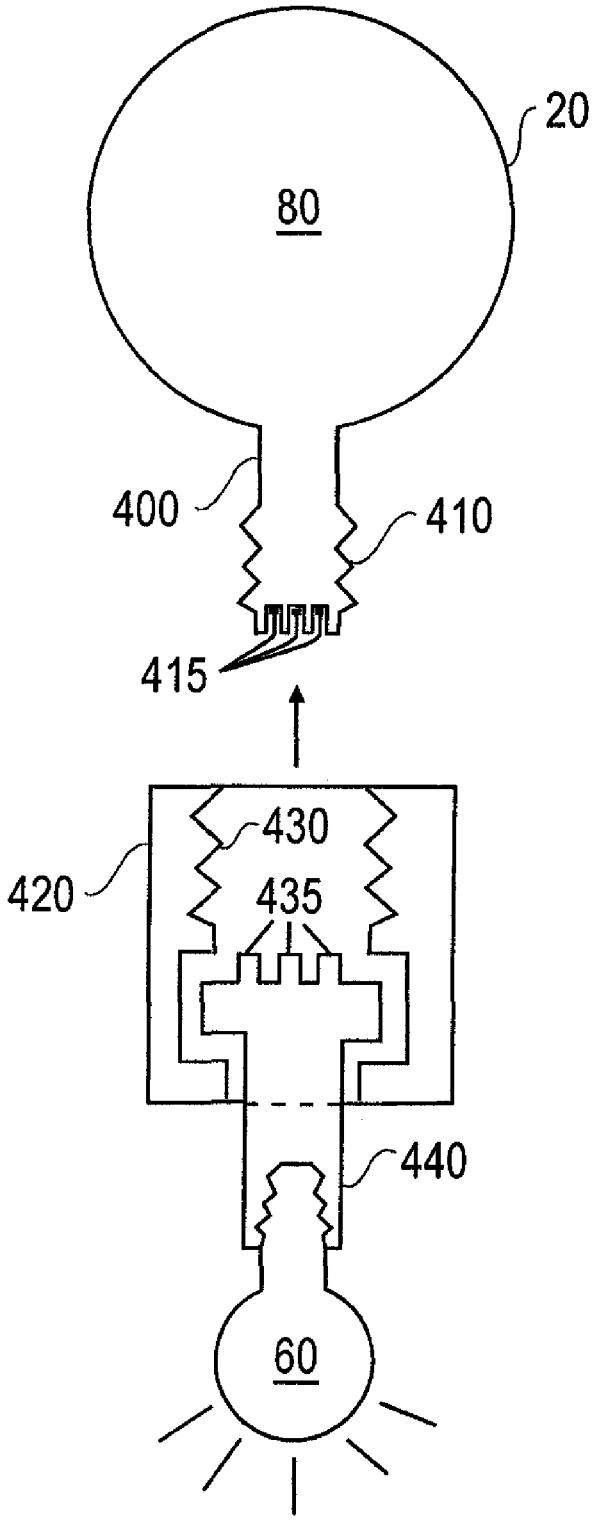
FIG. 7 illustrates further details of electrical connections between the track and the solid state light of a still further embodiment of the present invention.

While details of electrical connections to the lights 60 have not yet been shown, the invention contemplates the use of any electrical connections that provide necessary electrical power to the lights 60. One example of such electrical connections is illustrated in FIG. 7. Here, track 20 has a number of protrusions 400 that may contain fluid 80, or may also simply be made of any suitable thermally conductive material. The protrusions 400 include threads 410 (or any other suitable connecting device), and electrical connections 415. These connections 415 are well known in the art, and may be electrically connected to a power source or other electrical components, such as a driver, by any means, including by wires affixed to or embedded in the inner or outer surface of the track 20, or any other solid electrical conductor. A connector 420 includes threads 430 (or any other appropriate connector) for screwing into (or otherwise attaching to) the threads 410 of protrusion 400, and also holds socket 440 (or any other appropriate connector), which includes electrical connectors 435 that are configured to connect to corresponding ones of the connectors 415. The socket 440 also holds, and supplies power to, light 60 in known fashion. The configuration of FIG. 7 thus allows for a convenient, "screw-on" type of fixture that allows for easy attachment of light fixtures to track 20, while also providing a thermal pathway for heat transfer from light 60 to fluid 80. As above, the invention is not limited to these screw-on type fixtures, and can instead utilize any other lamp/socket or male/female electrical, mechanical or plumbing connector.

While the electrical connections of FIG. 7 are shown in connection with track 20, one of ordinary skill in the art will realize that the methods and/or apparatuses of FIG. 7 can be applied to any of the track lighting systems disclosed herein. Additionally, the sockets 440, and indeed any connection between track and bulb 60 of the invention, can each be configured to accept any standard track lighting connector or solid state bulb. For instance, they can each be configured with a socket sized to accept any standard Edison screw base. In particular, it is contemplated that sockets 440 (as well as any other light 60 interface contemplated by the invention) employed in the United States can be configured to accept any one or more of E5, E10, E11, E12, E17, E26, E26D, E29, and E39 screw bases, BA15S and BA15D bayonet bases, and G4 and GY6.35 bi-pin bases. Similarly, those employed in other locations, including Europe, can be configured to accept any one or more of E10, E11, E14, E27, and E40 screw bases, BA15S and BA15D bayonet bases, and G4 and GY6.35 bi-pin bases.

The foregoing description, for purposes of explanation, used specific nomenclature to provide a thorough understanding of the invention. However, it will be apparent to one skilled in the art that the specific details are not required in order to practice the invention. In other instances, well known devices are shown in block form in order to avoid unnecessary distraction from the underlying invention. Thus, the foregoing descriptions of specific embodiments of the present invention are presented for purposes of illustration and description. They are not intended to be exhaustive or to limit the invention to the precise forms disclosed. Rather, many modifications and variations are possible in view of the above teachings. For example, the invention contemplates the use of any appropriate fluid 80, light 60, propulsion devices 90, and electrical connections. Additionally, while certain shapes of track lighting tracks are shown for illustrative purposes, the invention contemplates any tracks shaped in any manner to hold fluid 80 and allow it to effectively dissipate heat from lights 60. The various drawings are not necessarily to scale. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A solid state light system, comprising:

a plurality of solid state light fixtures thermally coupled to a fluid cooling system, the fluid cooling system comprising at least one vessel for holding a thermally conductive fluid and a heat sink comprising a plurality of fins placed along the vessel and in thermal communication with the thermally conductive fluid, the vessel supporting a current in the thermally conductive fluid so as to facilitate a dissipation of heat from at least one of the solid state light fixtures, wherein the vessel comprises first and second ends, and wherein at least one solid light fixture is arranged proximate to the first end of the vessel so that heat from the at least one solid light fixture that is arranged proximate to the first end travels up along the first end of the vessel inducing the current to flow in a direction thereof;

wherein the at least one vessel further comprises a plurality of vessels, each in thermal communication with a corresponding one of the solid state light fixtures and each having a first portion having first and second ends and a second portion extending between, and in fluid communication with, the first and second ends of the first portion; and wherein the first and second portions are configured to support flow of the current therethrough.

2. The solid state light system of claim 1, wherein the current flows proximate to the heat sink so as to facilitate dissipation of the heat from the fluid and through the heat sink.

3. The solid state light system of claim 2, wherein the vessel further comprises an elongated portion supporting the plurality of solid state light fixtures thereon.

4. The solid state light system of claim 3, wherein the vessel further comprises a closed pipe having the elongated portion.

5. The solid state light system of claim 4, wherein the closed pipe has first and second ends that are closed ends.

6. The solid state light system of claim 4, wherein the closed pipe further comprises at least one fluid pathway extending generally along a closed path.

7. The solid state light system of claim 6, wherein the closed pipe further comprises multiple ones of the fluid pathways, each one of the fluid pathways in fluid communication with at least one other one of the fluid pathways.

8. The solid state light system of claim 2, wherein the heat sink comprises a plurality of fins in thermal communication with the vessel and configured to dissipate heat from the fluid, the fins extending in a direction generally parallel to the vessel.

9. The solid state light system of claim 2, wherein the heat sink comprises a plurality of fins in thermal communication with the vessel and configured to dissipate heat from the fluid, the fins extending in a direction generally perpendicular to the vessel.

10. The solid state light system of claim 1, further comprising a track lighting track coupled to the fluid cooling system.

11. The solid state light system of claim 10, wherein the vessel is contained within the track.

12. The solid state light system of claim 1, wherein the fluid cooling system further comprises a plurality of heat sink fins extending from the track, and wherein each of the second portions is positioned in a corresponding one of the heat sink fins.

13. The solid state light system of claim 1, wherein the heat from the solid state light fixtures drives the current in the fluid.

14. A cooling system for lights, comprising:

a track lighting track;

a plurality of solid state light fixtures coupled to the track;

at least one enclosed reservoir containing a thermally conductive fluid, the at least one reservoir placing the solid state light fixtures in thermal communication with the fluid, the at least one reservoir having a shape allowing heat from the solid state light fixtures to induce a current in the fluid;

a heat sink comprising a plurality of fins placed along the track in thermal communication with the fluid and configured to dissipate heat from the fluid as the current carries the fluid past the heat sink, wherein the track comprises a first end and a second end, and wherein at least one solid light fixture is arranged proximate to the first end of the track so that heat from the side solid light fixture that is arranged proximate to the first end of the track travels up along the first end of the track inducing the current to flow in a direction thereof; and wherein the at least one reservoir is a plurality of reservoirs each thermally coupled to one of the light fixtures, each reservoir having a first fluid pathway extending generally along a closed path, and a second fluid pathway in fluid communication with the first fluid pathways, the heat from the one of the solid state light fixtures inducing the current in a direction along the second fluid pathway.

15. The cooling system of claim 14, wherein the at least one reservoir is a pipe containing the fluid and having a continuous, closed-loop shape in thermal communication with the plurality of solid state light fixtures and the heat sink, the heat from the solid state light fixtures inducing the current flowing through the pipe and past the heat sink.

16. The cooling system of claim 14, wherein the heat sink comprises a plurality of fins, each fin positioned proximate to and in thermal communication with a corresponding one of the first fluid pathways, so as to facilitate dissipation of heat from the first fluid pathways.

17. The cooling system of claim 14, wherein the heat sink comprises a plurality of fins, and wherein each of the first fluid pathways is positioned in a corresponding one of the fins.

18. The cooling system of claim 14, wherein the heat sink comprises a plurality of fins in thermal communication with the reservoir.

19. The cooling system of claim 14, wherein the track further comprises the at least one enclosed reservoir.

* * * * *